United States Patent [19]

Hartmann

[11] Patent Number: 4,555,109

[45] Date of Patent: Nov. 26, 1985

[54] EXERCISING MACHINE

[76] Inventor: Joseph C. Hartmann, 4030 N. Tracy, Kansas City, Mo. 64116

[21] Appl. No.: 532,223

[22] Filed: Sep. 14, 1983

[51] Int. Cl.[4] ..... A63B 21/00

[52] U.S. Cl. ..... 272/73; 272/72; 272/70

[58] Field of Search ..... 272/72, 73, 130, 134, 272/70, DIG. 9; 280/289 R, 234, 240, 282

[56] References Cited

U.S. PATENT DOCUMENTS

| | | | |
|---|---|---|---|
| 2,145,940 | 2/1939 | Marlowe | 272/72 |
| 2,390,719 | 12/1945 | Kurth | 280/234 |
| 3,572,699 | 3/1971 | Nies | 272/73 |

*Primary Examiner*—Richard J. Apley
*Assistant Examiner*—S. R. Crow
*Attorney, Agent, or Firm*—Schmidt, Johnson, Hovey & Williams

[57] ABSTRACT

An exercising machine has a handlebar swingable back and forth about a vertical axis and a pair of cranks, each provided with a foot pedal, and swingable up and down about a horizontal axis. A reciprocable connector causes simultaneous swinging of the handlebar and the cranks. The oscillatory movements of the handlebar and the cranks permit the use of leg and/or arm power by the operator to provide much the same type of bodily movements and muscular activity as is normal in walking, jogging and running exercises.

18 Claims, 8 Drawing Figures

Fig. 1
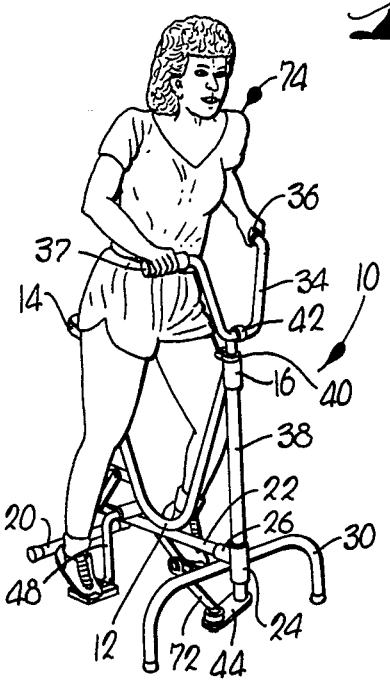
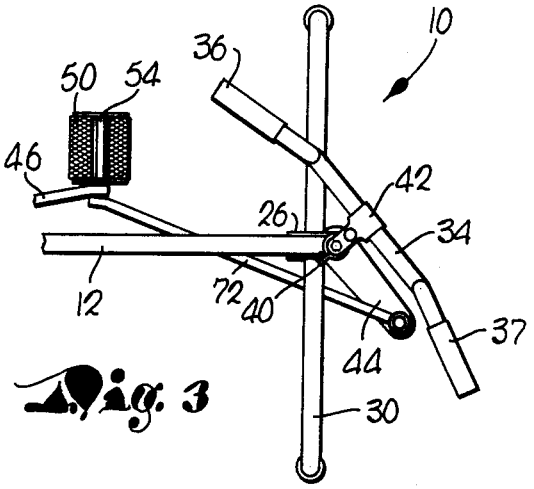
Fig. 3
Fig. 2
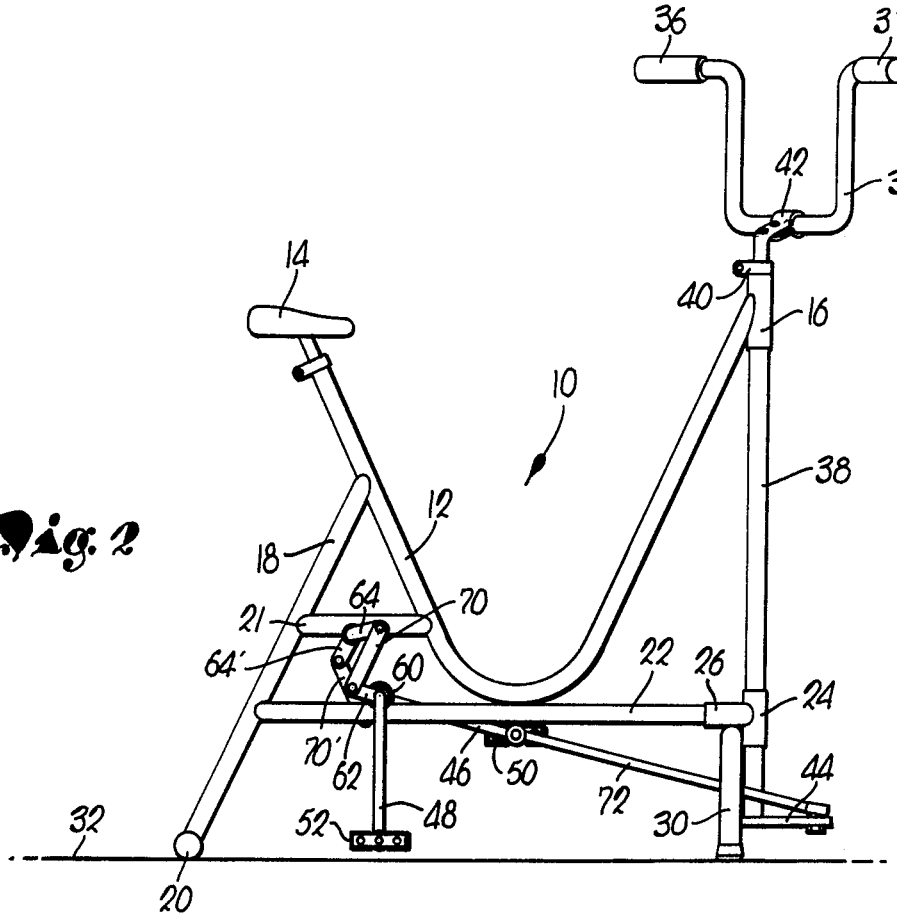

Fig. 4
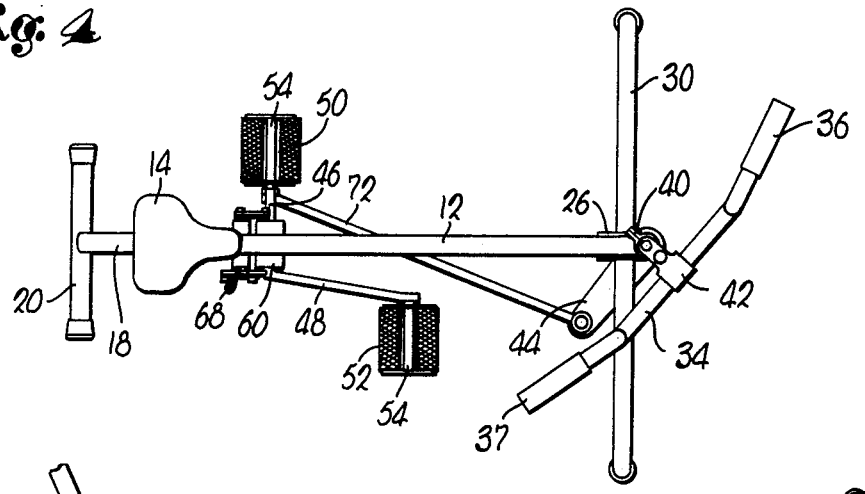
Fig. 5
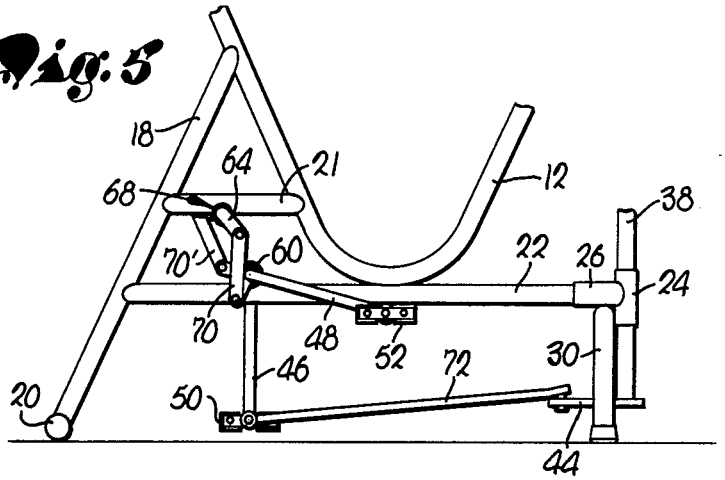
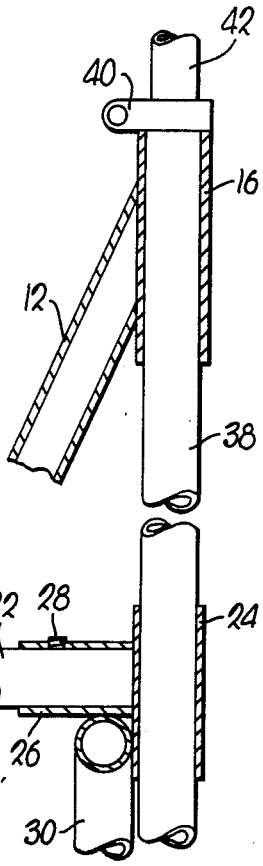
Fig. 8
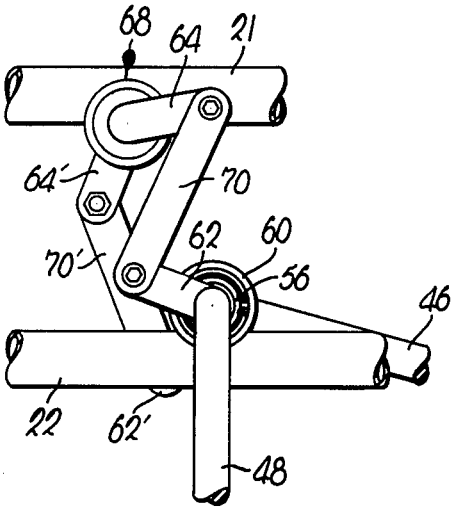
Fig. 6
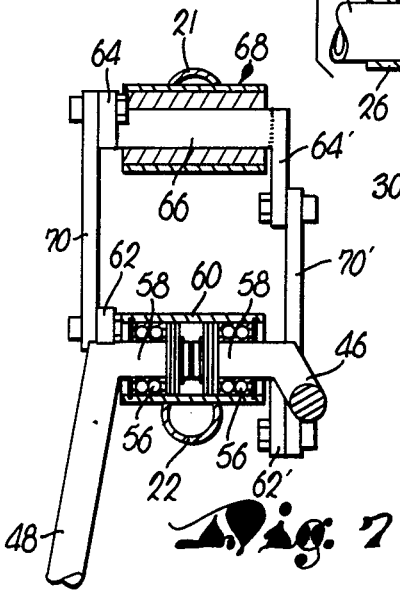
Fig. 7

EXERCISING MACHINE

Through use of a suitable frame, supported and stabilized by base means in an immobile condition on an underlying surface, a handlebar and foot pedal arrangement is provided in an exercising machine which will develop and maintain physical fitness much the same as the physical exertion and bodily movements which take place during the normal human acts of walking, jogging or running.

The handlebar oscillates at the upper, forwardmost zone of the frame about a vertical axis. Pedal-receiving cranks disposed downwardly and rearwardly of the handlebar oscillate forwardly and upwardly about a horizontal axis through arcs of less than 90°. The cranks are not connected directly, but they oscillate simultaneously by provision of a pair of opposed linkages. At all times the vertically suspended positions of the cranks alternate during use. A connector is employed to cause the handlebar to swing in one direction as one pedal moves downwardly and rearwardly and cause the handlebar to swing the opposite direction when the other pedal moves downwardly and rearwardly. Arm power is applied to the handlebar and/or leg power is applied to the foot pedals when the operator is astride the exerciser either in a standing or a seated position.

The prior art with which I am familiar neither discloses nor suggests the novel combination of parts of my exerciser and fails to provide the same or comparable end results.

Selnes, U.S. Pat. No. 3,792,860, of 2/1974 provides platforms, pulley and cable arrangements and other components totally different from those of my present invention for the purpose of multitudes of exercises, none of which is the same as or similar to the kind of exercising made possible by my present invention.

Spain, U.S. Pat. No. 1,715,870, of 6/1929 contemplates simulation of rowing a boat with a pulling action on a handlebar, again through a pulley and cable arrangement. The foot pedals move fore and aft along a bar against the action of elastic members, such elasticity also being used in connection with the simulated oars in the form of a handlebar. No such action or parts are contemplated in the instant invention.

Ragone, U.S. Pat. No. 3,940,128, of 2/1976, unlike my invention, rotates pedalled cranks the same as in an ordinary bicycle. Moreover, the handlebar and the seat of the apparatus swing fore and aft under the power exerted by the legs of the operator, there being no rotation of the handlebar as the result of the simulation of a pedalled vehicle such as a bicycle.

Agamian, U.S. Pat. No. 3,758,111, also employs the commonplace bicycle pedal rotation principle, all in conjunction with swingable handles such that the angle of the operator varies during operation.

Weiss, U.S. Pat. No. 3,566,861, of 3/1971 combines a pair of upright levers with a pair of foot pedals that reciprocate fore and aft along a pair of tracks.

In Carnielli, U.S. Pat. No. 3,964,742, of 6/1976 the operator rotates a hand wheel arrangement while rotating a bicycle type pedal assembly.

And, once again, Hooper, U.S. Pat. No. 4,188,030 of 2/1980 uses a bicycle type pedal arrangement in connection with a pair of upstanding levers which swing fore and aft.

In the drawings:

FIG. 1 is a perspective view of the exercising machine forming the subject matter of my present invention showing an operator thereon;

FIG. 2 is an enlarged, side elevational view thereof with the component parts disposed the same as in FIG. 1;

FIG. 3 is a fragmentary, top plan view thereof with component parts disposed the same as in FIGS. 1 and 2;

FIG. 4 is a top plan view thereof with the component parts shown in their alternate positions;

FIG. 5 is a fragmentary, side elevational view thereof with the component parts disposed the same as in FIG. 4;

FIG. 6 is a fragmentary, detailed side elevational view similar to FIG. 2, still further enlarged with the component parts disposed the same as in FIGS. 1—3;

FIG. 7 is a fragmentary, detailed, vertical cross sectional view through the frame and the bearings for the cranks looking forwardly, with the component parts disposed the same as in FIGS. 1—3 and 6; and FIG. 8 is an enlarged, fragmentary, vertical cross sectional view through the frame showing the handlebar mounting means.

A frame 10 has a U-shaped framepiece 12 provided with a seat 14 adjustably mounted on its upper, rearmost end and with a short, upright, upward tube 16 rigid to its upper, forewardmost end and spaced forwardly of the seat 14 in fore to aft alignment with the latter. An inclined, T-shaped rear leg 18, rigid to and extending rearwardly and downwardly from the framepiece 12, has a rear transverse foot 20. A short framepiece 21 rigidly interconnects the framepiece 12 and the leg 18.

An elongated, horizontal framepiece 22 below the framepiece 21 is rigid to the leg 18 above the foot 20 as well as to the bight of the framepiece 12, and extends forwardly from such bight, terminating at its forwardmost end in a short, upright, lower tube 24 vertically aligned with the tube 16. The tube 24 has a rearwardly-extending, tubular portion 26 rigid thereto and receiving the forwardmost end of the framepiece 22.

A fastener, such as a set screw 28 (FIG. 8) releasably attaches the portion 26 to the framepiece 22. A front foot 30 of inverted U-shape and appreciably longer than the foot 20 is fixed at its bight to the tube 24 and its portion 26. The feet 20 and 30 serve as base means to present a solid bottom by which the frame 10 is supported and stabilized in an immobile condition on an underlying surface 32.

A handlebar 34, which may be U-shaped as shown, and adjustable up and down, has a pair of spaced portions at its ends normally covered by handgrips 36 and 37. Means is provided between the handgrips 36,37 for swingably mounting the handlebar 34 on the frame 10 for oscillatory movement about an essentially upright axis extending upwardly from the tube 16 of the frame 10. Such mounting means includes an elongated member 38 extending through the tubes 16 and 24 for oscillation about its longitudinal axis. A releasable clamp 40 on the member 38 rests on the tube 16 and an L-shaped device 42, releasably clamped to the handlebar 34 at its bight, extends into the member 38 and has releasable connection therewith. A lateral extension 44 rigid to the lower end of the member 38 is spaced slightly above the surface 32.

Each of a pair of elongated cranks 46 and 48, one on each side respectively of the frame 10, and disposed downwardly and rearwardly of the handlebar 34, above the surface 32, is provided with means for swingably attaching the same to the frame 10 for oscillatory movement about a substantially horizontal axis transversely of the frame 10. Foot pedals 50 and 52 for cranks 46 and 48 respectively are pivotally secured thereto by removable pivot pins 54.

The means for attaching the cranks 46, 48 to the frame 10 includes a separate bearing 56 for each laterally extending element 58 of the cranks 46, 48 contained in a common casing 60 which is, in turn, fixed to the framepiece 22 thereabove and thereacross between the leg 18 and the bight of the framepiece 12. Noteworthy from viewing FIG. 7 is the fact that the elements 58 are in spaced, end-to-end relationship for oscillation about aligned, horizontal axes.

Means for interconnecting the cranks 46, 48 for simultaneous oscillation includes a pair of interconnected linkage means, one for each crank 46, 48 respectively and disposed one on each side respectively of the frame 10. Inasmuch as such linkages are identical, only that which is associated with the crank 48 will be explained, like numbers suitably primed to be used for the linkage of the crank 46.

A lower link 62 is fixed rigidly to the element 58 of the crank 48, extends radially therefrom and oscillates therewith. An upper link 64 is fixed rigidly to one end of a crosspin 66 (FIG. 7) having link 64' rigidly fixed to the opposite end thereof. The crosspin 66 is carried by a bushing 68 for oscillation about an axis in spaced parallelism with the axes of oscillation of the elements 58 of the cranks 46, 48, the bushing 68 being fixed to the framepiece 21 therebeneath. An intermediate link 70 is pivotally connected to the link 62 and to the link 64.

Means operably interconnecting the crank 46 and the mounting means for the handle 34 includes an elongated connector 72 pivotally joined at its rearmost end to the pin 54 of the pedal 50 (FIG. 3) and pivotally joined to the extension 44 at its opposite end, the latter joinder being spaced radially outwardly from the member 38. Thus, the connector 72 synchronizes the oscillatory movements of the handlebar 34 and the cranks 46, 48 to the end that such movements may be powered by the legs, arms or both of a human operator 74, either while standing on the pedals 50, 52 (FIG. 1) or while resting on the seat 14.

OPERATION

Viewing FIGS. 1–3, 6 and 7, when arm power is applied to the handlebar 34 for swinging it to the left, and/or leg power is applied to the pedals 50, 52, the pedal 52 moves downwardly and rearwardly approximately 70° to a position where its crank 48 depends vertically from the casing 60. Such power is transmitted to and/or from the handlebar 34 through the member 38, its extension 44, the connector 72, the crank 46 and pedal 50, one element 58, the linkage 62', 70', 64', the pin 66, the linkage 64, 70 and 62, the other element 58 and the crank 48 to the pedal 52. Thus, simultaneously the pedal 52 swings upwardly and forwardly to a position where its crank 46 extends forwardly and downwardly from the casing 60. Conversely, when power is applied oppositely, the handlebar 34 swings from the position shown in FIG. 3 to the position shown in FIG. 4 and the pedals 50, 52, as well as their cranks 46, 48 assume the position shown best in FIG. 5.

Thus, during use of my exerciser, the "gait" or manner of stepping or movement of the feet and legs, as well as movement of the arms, and the carriage as well as movement of the body of the operator 74 are all much the same as normally occurs inherently and quite spontaneously in a lifelike and natural manner during walking, jogging or running. Therefore, it is manifest that proper and periodic use of the exerciser above described will help most people develop and maintain good health and physical fitness.

The overall construction is such as to permit the exerciser to be power driven, for example, by a motor coupled with any one of a number of the moveable parts carried by the frame 10. For shipping or storage purposes, the handlebar 34 may be separated from the member 38, the clamp 40 removed, the connector 72 disconnected from the extension 44, and the set screw 28 loosened. After pulling member 38 out of the tubes 16 and 24, the portion 26 of the tube 24 is removed from the framepiece 22. The separate parts then include the handlebar 34, the member 38 and the foot 30 still attached to the tube 24 and its portion 26, all capable of positioning alongside the frame 10.

I claim:

1. An exercising machine for permitting physical exertion and bodily movements comparable to the normal, human acts of walking, running or jogging for the sake of developing and maintaining physical fitness, said machine comprising:

a frame having base means, presenting a bottom by which the frame is supported and stabilized in an immobile condition on an underlying surface;

a handlebar having a pair of spaced portions adapted to be grasped by the hands;

means intermediate the ends of the handlebar between said portions pivotally mounting the same on the frame for oscillatory movement about an essentially upright axis extending upwardly from the frame;

a pair of elongated cranks, one on each side respectively of the frame and disposed downwardly and rearwardly of the handlebar above said surface;

means for each crank respectively pivotally attaching the same to the frame for limited oscillatory movement about a substantially horizontal axis transversely of the frame;

means operably intercoupling the cranks for simultaneous oscillation;

a foot pedal pivotally secured to each crank respectively at one of the ends of the cranks; and means operably interconnecting one of the cranks and said pivotally mounting means for synchronizing the oscillatory movements of the handlebar and the cranks whereby said movements may be powered by a human operator's legs, arms or both.

2. The invention of claim 1, said mounting means including an elongated member having a lowermost end remote from the handlebar adjacent but above said surface, said member being secured to the handlebar and being carried by the frame for oscillation about said essentially upright axis.

3. The invention of claim 2, said member having a lateral extension rigid thereto at its lowermost end forming a part of said interconnecting means.

4. The invention of claim 3, said one crank having a pivot pin securing its pedal thereto, said interconnecting means including an elongated connector pivotally joined with said pin at one end of the connector and pivotally joined with said extension at the opposite end of the member.

5. The invention of claim 1, each crank having a laterally extending element at the opposite end thereof provided with a bearing secured rigidly to the frame, said elements and said bearings forming a part of said attaching means.

6. The invention of claim 5, said elements being disposed in spaced, end-to-end relationship for oscillation within their bearings about aligned, substantially horizontal axes.

7. The invention of claim 1, said intercoupling means including linkage for each crank respectively.

8. The invention of claim 7, each linkage including a lower link, an upper link and an intermediate link pivotally coupled with the upper and with the lower link.

9. The invention of claim 8, each lower link being rigid to its corresponding crank.

10. The invention of claim 9, the upper links being rigidly interconnected.

11. The invention of claim 9, said intercoupling means including a cross-pin carried by the frame for oscillation about an axis disposed in spaced parallelism with the axes of oscillation of the cranks.

12. The invention of claim 11, each upper link being rigid to the cross-pin.

13. The invention of claim 8, each crank having a laterally-extending element at the opposite end thereof provided with a bearing secured rigidly to the frame, said elements and said bearings forming a part of said attaching means.

14. The invention of claim 13, each lower link being rigid to its corresponding element.

15. An exercising machine comprising:

a frame;

a handlebar disposed at an uppermost and forwardmost extremity of the frame, said handlebar having a pair of spaced end portions adapted to be grasped by the hands;

means pivotally mounting the handlebar on the frame for limited oscillation of less than 360 degrees alternately to the right and to the left about an essentially upright axis;

a pair of elongated cranks, one on each side respectively of the frame and disposed downwardly and rearwardly of the handlebar, each crank being provided with a foot pedal;

means for each crank respectively pivotally attaching the same to the frame for limited oscillatory movement of less than 360 degrees about a substantially horizontal axis;

means operably intercoupling the cranks for movement of one of the pedals upwardly and forwardly as the other pedal moves downwardly and rearwardly such that said one pedal moves downwardly and rearwardly as said other pedal moves upwardly and forwardly; and means for rotating the handlebar to the right as said one pedal moves upwardly and forwardly and swinging the handlebar to the left as said other pedal moves upwardly and forwardly such that, as the one pedal moves downwardly and rearwardly, the handlebar swings to the left and, as the other pedal moves upwardly and forwardly, the handlebar swings to the left.

16. The invention of claim 15, said means for swinging the handlebar including an interconnection between said mounting means and said one crank.

17. The invention of claim 15, said intercoupling means including a pair of identical, interconnected linkage means one for each crank respectively.

18. The invention of claim 17, each linkage means having a link rigid to the corresponding crank.

* * * * *